US012798830B2

(12) United States Patent
Kaneko et al.

(10) Patent No.: US 12,798,830 B2
(45) **Date of Patent: *Nov. 17, 2026**

(54) FIXING MEMBER

(71) Applicant: FUJIFILM Business Innovation Corp., Tokyo (JP)

(72) Inventors: Michiaki Kaneko, Kanagawa (JP); Shigeru Tsukada, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 18/182,368

(22) Filed: Mar. 13, 2023

(65) Prior Publication Data

US 2024/0101310 A1 Mar. 28, 2024

(30) Foreign Application Priority Data

Sep. 28, 2022 (JP) ..... 2022-154892

(51) Int. Cl.
*B65D 19/44* (2006.01)

(52) U.S. Cl.
CPC ..... *B65D 19/44* (2013.01)

(58) Field of Classification Search
CPC ..... B65D 19/44
See application file for complete search history.

(56) References Cited

U.S. PATENT DOCUMENTS 2,651,483 A * 9/1953 Ritchie ..... B41J 29/04 248/500
RE28,035 E * 6/1974 Fork ..... H02G 3/283 248/500
5,842,424 A * 12/1998 Prevot ..... B65D 19/44 108/55.3
8,425,165 B2 4/2013 Harada et al.
(Continued)

FOREIGN PATENT DOCUMENTS

EP 1547931 6/2005
JP H1095429 4/1998
(Continued)

OTHER PUBLICATIONS

"Notice of Reasons for Refusal of Japan Counterpart Application", issued on Apr. 28, 2026, with English translation thereof, p. 1-p. 5.

*Primary Examiner* — Daniel J Rohrhoff
(74) *Attorney, Agent, or Firm* — JCIPRNET

(57) ABSTRACT

A fixing member that fixes a lower surface of an apparatus having a caster to an upper surface of a base includes: an engagement part that is inserted through a through hole provided in the lower surface of the apparatus, extends along an upper side of the lower surface of the apparatus, and is engaged with the lower surface of the apparatus; an attachment part that extends along an upper side of the upper surface of the base so as to face the engagement part and is attached to the upper surface of the base; a connection part that connects the engagement part and the attachment part by passing through the through hole; and a load receiving
(Continued)

part that is provided on a side opposite to the engagement part relative to the connection part and receives a load by making contact with a lower side of the lower surface of the apparatus.

8 Claims, 4 Drawing Sheets

(56) References Cited

U.S. PATENT DOCUMENTS

| | | | | |
|---|---|---|---|---|
| 9,163,842 | B2 * | 10/2015 | Adams | A47B 91/08 |
| 11,999,527 | B2 * | 6/2024 | Tsukada | B65D 81/02 |
| 2005/0150194 | A1 * | 7/2005 | Okamuro | B65D 19/44 53/494 |
| 2012/0067253 | A1 * | 3/2012 | Harada | B65D 19/0026 108/55.1 |
| 2018/0134445 | A1 * | 5/2018 | Chezem | B65D 81/054 |
| 2022/0348378 | A1 * | 11/2022 | Suruga | B65D 81/02 |
| 2022/0396395 | A1 * | 12/2022 | Kono | B65D 19/44 |
| 2023/0023277 | A1 * | 1/2023 | Tsukada | B65D 19/44 |
| 2023/0028458 | A1 * | 1/2023 | Endo | B65D 19/44 |
| 2023/0129657 | A1 * | 4/2023 | Yamada | F16F 7/00 108/57.12 |
| 2024/0103412 | A1 * | 3/2024 | Kaneko | G03G 21/1647 |
| 2024/0327105 | A1 * | 10/2024 | Suruga | B65D 81/02 |

FOREIGN PATENT DOCUMENTS

| | | |
|---|---|---|
| JP | 2005186939 | 7/2005 |
| JP | 2012062112 | 3/2012 |

* cited by examiner

FIXING MEMBER

CROSS-REFERENCE TO RELATED APPLICATIONS

This application is based on and claims priority under 35 USC 119 from Japanese Patent Application No. 2022-154892 filed Sep. 28, 2022.

BACKGROUND

(i) Technical Field

The present disclosure relates to a fixing member.

(ii) Related Art

Japanese Unexamined Patent Application Publication Mo. 10-095429 describes a support structure for a pallet for mounting of an apparatus. This support structure is a support structure for a pallet for elastically supporting and fixing an apparatus having a caster and includes an elastic member that is detachably housed in a groove part of a deck board provided on an upper surface of the pallet and supports the caster, and a fixing member that is detachably inserted between a lower surface of the apparatus and the deck board and is fixed to the lower surface of the apparatus and the deck board only by bolt fastening or nut fastening, and an upper surface of the elastic member is almost flush with the upper surface of the deck board.

Japanese Unexamined Patent Application Publication Mo. 2012-062112 describes a fixing member in a pallet apparatus. This fixing member is fixed to a pallet base with the use of a screw member, has a U-shaped cross section, and has plural slits through which the screw member can pass. A position of a bottom surface of a product is changed by using the slits and the screw member, and thereby the fixing member can be easily put into a position below the product and taken out from the position below the product.

SUMMARY

For example, in a case where an apparatus having a caster on a bottom surface thereof such as an image forming apparatus is transported while being placed on a base such as a pallet, the apparatus is transported in a state where a lower surface of the apparatus and an upper surface of the base are fixed by using a fixing member.

Some fixing members can be attached to an apparatus by engagement (sometimes called "engagement type") of an engagement part inserted through a through hole provided in a lower surface of the apparatus. Use of the engagement type makes it easier to attach a fixing member to an apparatus than a fixing member attached by using a screw member such as a bolt or a nut (sometimes called "screw type").

An engagement type fixing member needs to be provided with a load receiving part that supports a load of an apparatus on a lower side of a lower surface of the apparatus. However, in a case where an engagement part and a load receiving part extend in a same direction, the load receiving part and the lower surface of the apparatus interfere with each other when the engagement part is inserted into a through hole. This lowers workability related to attachment of the fixing member.

Aspects of non-limiting embodiments of the present disclosure relate to a fixing member that keeps workability related to attachment of the fixing member from decreasing as compared with a case where an engagement part and a load receiving part are provided on a same side.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a fixing member that fixes a lower surface of an apparatus having a caster to an upper surface of a base, the fixing member including: an engagement part that is inserted through a through hole provided in the lower surface of the apparatus, extends along an upper side of the lower surface of the apparatus, and is engaged with the lower surface of the apparatus; an attachment part that extends along an upper side of the upper surface of the base so as to face the engagement part and is attached to the upper surface of the base; a connection part that connects the engagement part and the attachment part by passing through the through hole; and a load receiving part that is provided on a side opposite to the engagement part relative to the connection part and receives a load by making contact with a lower side of the lower surface of the apparatus.

BRIEF DESCRIPTION OF THE DRAWINGS

An exemplary embodiment of the present disclosure will be described in detail based on the following figures, wherein:

FIG. 2A is a perspective view of the fixing member, and FIG. 2B is a cross-sectional view taken along line IIB-IIB in FIG. 2A;

FIG. 3A illustrates how the fixing member is inserted between a lower surface of the image forming apparatus and an upper surface of the base, FIG. 3B illustrates how the engagement part is inserted through a through hole, and FIG. 3C illustrates how the engagement part is engaged.

DETAILED DESCRIPTION

Fixing of Apparatus by Fixing Member

An exemplary embodiment of the present disclosure (hereinafter sometimes referred to as a "present exemplary embodiment") is described below with reference to the attached drawings.

First, fixing of an apparatus by a fixing member is described. In the following description, a case where an image forming apparatus, which is an example of an apparatus having a caster, is fixed to a pallet, which is an example of a base, is taken as an example.

Figure 1:
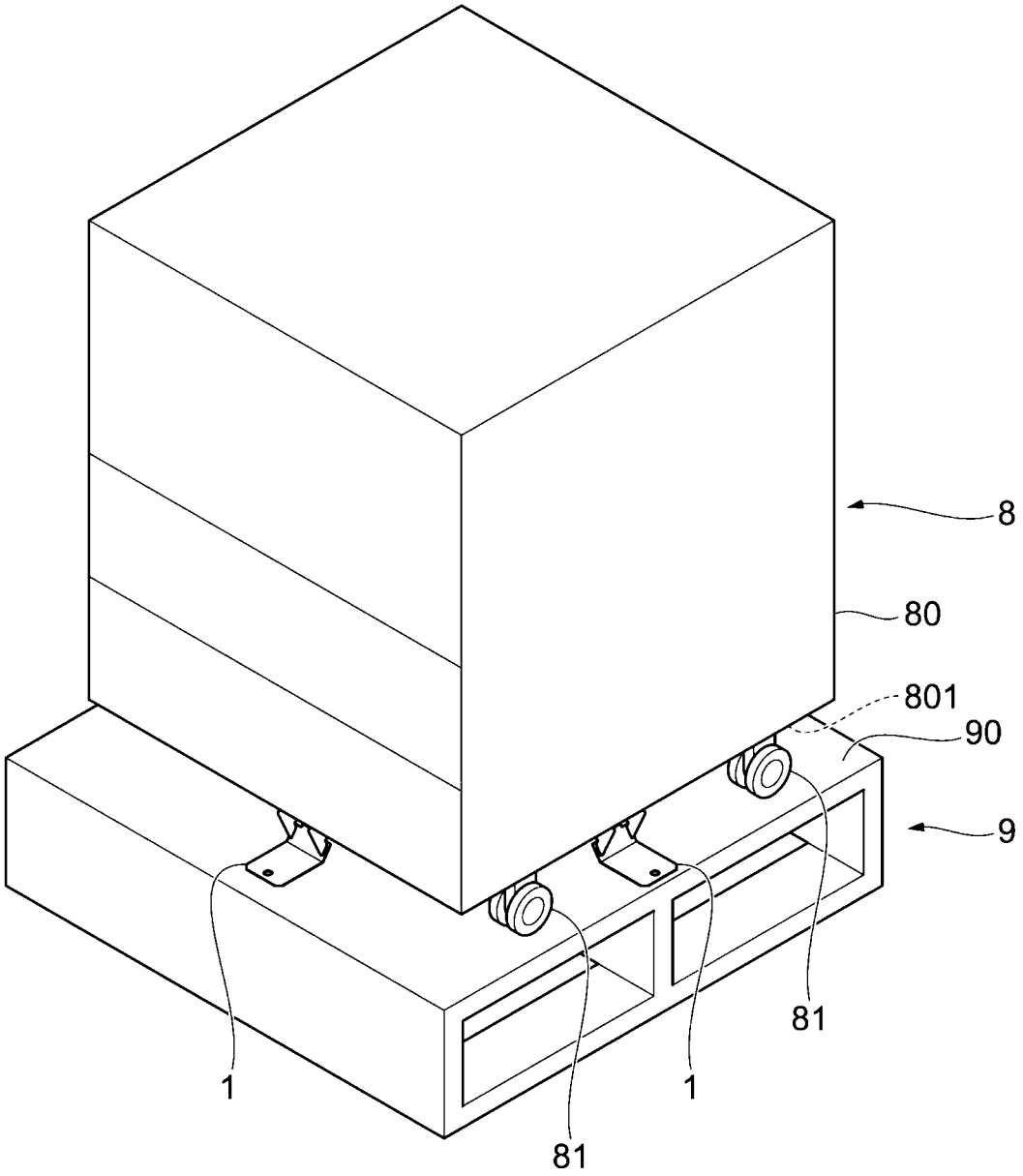
FIG. 1 illustrates a state where an image forming apparatus is fixed to a pallet by a fixing member.

FIG. 1 illustrates a state where an image forming apparatus 8 is fixed to a pallet 9 by a fixing member 1. In the following description, it is assumed that a side where the pallet 9 is located relative to the image forming apparatus 8 is a lower side and a side where the image forming apparatus 8 is located relative to the pallet 9 is an upper side.

The image forming apparatus 8 includes a body 80 including various functional parts such an image forming part and a caster 81 that supports the body 80 so that the body 80 is movable.

The caster 81 is attached to a lower surface 801 of the body 80 and allows the body 80 to move in a front-rear direction, a left-right direction, and oblique directions by a wheel.

The lower surface 801 is a housing of the body 80 and is a lower end in external appearance of the body 80. The lower surface 801 is, for example, made of an elastic material such as plastic.

The pallet 9 is a block on which the image forming apparatus 8 is placed, for example, when the image forming apparatus 8 is transported, and is, for example, made of an elastic material such as wood or plastic.

The pallet 9 has, in a side surface (given no reference sign) thereof, a groove (a fork pocket) into which a claw of a forklift is to be inserted so that the pallet 9 and the image forming apparatus 8 can be lifted up and transported by the forklift.

Although the lower surface 801 of the image forming apparatus 8 and an upper surface 90 of the pallet 9 are described as flat surfaces that face each other, the lower surface 801 and the upper surface 90 may be curved surfaces or may have an irregular shape provided with a groove, a protrusion, a hole, or the like.

Since the image forming apparatus 8 has the caster 81 as described above, the image forming apparatus 8 needs to be fixed on the pallet 9 so as not to move at least when the image forming apparatus 8 is transported.

As illustrated in FIG. 1, the fixing member 1 ties and fastens the lower surface 801 of the image forming apparatus 8 and the upper surface 90 of the pallet 9 to each other and thereby fixes the image forming apparatus 8 so that the image forming apparatus 8 does not move on the pallet 9.

In the example of FIG. 1, the image forming apparatus 8 is fixed by four fixing members 1 attached on front and rear sides and left and right sides. Among the four fixing members 1, two fixing members 1 are hidden by the image forming apparatus 8 and therefore are not illustrated.

Fixing Member 1

Next, the fixing member 1 to which the present exemplary embodiment is applied is described in detail.

Figure 2A:
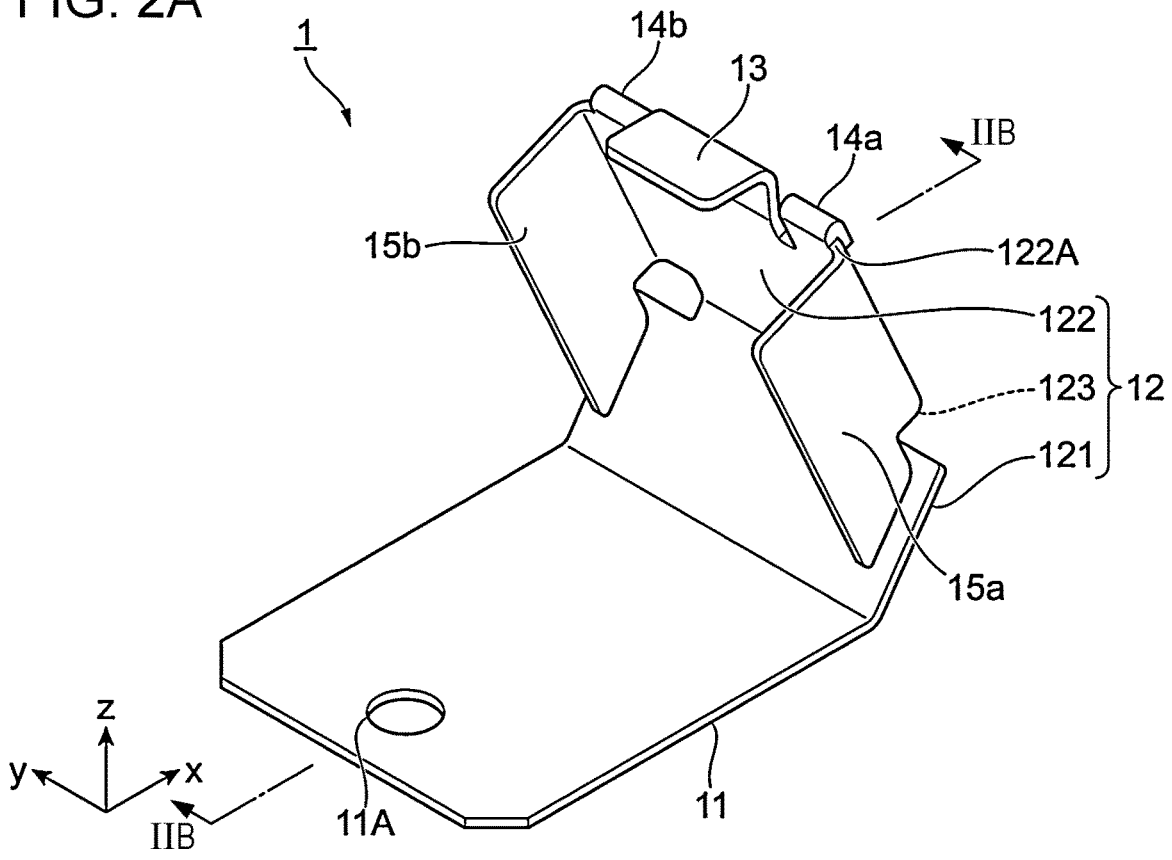
FIGS. 2A and 2B are views for explaining a fixing member to which an exemplary embodiment of the present disclosure is applied.
Figure 2B:
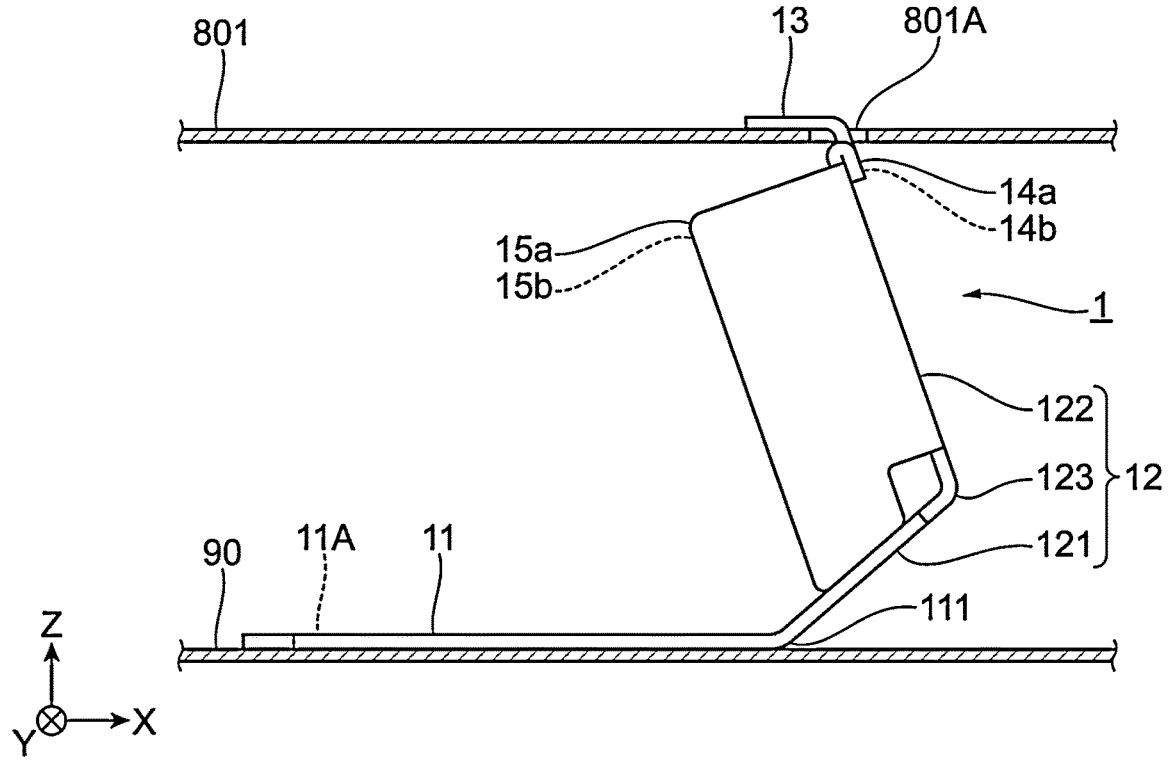

FIGS. 2A and 2B are views for explaining the fixing member 1 to which the exemplary embodiment of the present disclosure is applied. FIG. 2A is a perspective view of the fixing member 1, and FIG. 2B is a cross-sectional view taken along line IIB-IIB in FIG. 2A. Note that a state (hereinafter sometimes referred to as an "attachment state") where the fixing member 1 is attached to the lower surface 801 of the image forming apparatus 8 and the upper surface 90 of the pallet 9 is illustrated for explanation in FIG. 2B.

A direction toward an upper right side, a direction toward an upper left side, and a direction toward an upper side in FIG. 2A are a +x direction, a +y direction, and a +z direction, respectively, and a direction toward a right side, a direction toward a rear face of the paper on which FIG. 2B is drawn (a direction toward a depth side), and an upper side in FIG. 2B are the +x direction, the +y direction, and the +z direction, respectively.

As illustrated in FIGS. 2A and 2B, the fixing member 1 to which the present exemplary embodiment is applied includes an attachment part 11, a connection part 12, an engagement part 13, a load receiving part 14 (load receiving parts 14*a* and 14*b*), and a lateral supporting part 15 (lateral supporting parts 15*a* and 15*b*).

A plate member that forms the fixing member 1 may be, for example, a metal plate.

The attachment part 11 is a part for attaching the fixing member 1 to the pallet 9, and extends along an upper side of the upper surface 90 of the pallet 9 in the attachment state, as illustrated in FIG. 2B.

As illustrated in FIG. 2A, the attachment part 11 according to the present exemplary embodiment has a plate shape and has a screw hole 11A. The attachment part 11 is attached to the upper surface 90 by a screw member (not illustrated) passing through the screw hole 11A.

Although an example in which the attachment part 11 has a hexagonal shape is illustrated in FIG. 2A, the shape of the attachment part 11 is not limited.

The connection part 12 is a part that connects the attachment part 11 and the engagement part 13. More specifically, in the attachment state, the connection part 12 connects the attachment part 11 and the engagement part 13 by passing through a through hole 801A provided in the lower surface 801 of the image forming apparatus 8, as illustrated in FIG. 2B.

In other words, one end (an end in the −z direction in FIG. 2B) of the connection part 12 is continuous with the attachment part 11, and the other end (an end in the +z direction in FIG. 2B) of the connection part 12 is continuous with the engagement part 13. Note that an end part of the attachment part 11 continuous with the one end of the connection part 12 is referred to as an end part 111.

The connection part 12 according to the present exemplary embodiment is a plate member that is bent in a direction away from the engagement part 13 (the +x direction) at a bent part 123, and has a lower part 121 on a lower side (i.e., a side close to the attachment part 11) relative to the bent part 123 and an upper part 122 on an upper side (i.e., a side close to the engagement part 13) relative to the bent part 123.

The lower part 121 extends from the bent part 123 toward an oblique direction that is the −x direction and the −z direction.

The upper part 122 extends from the bent part 123 toward an oblique direction that is the −x direction and the +z direction.

The engagement part 13 is a part for engaging the fixing member 1 with the lower surface 801 of the image forming apparatus 8, and extends along an upper side of the lower surface 801 so as to face the attachment part 11 in the attachment state, as illustrated in FIG. 2B. In the example of FIG. 2B, the attachment part 11 and the engagement part 13 extend toward the −x direction so as to face each other.

The engagement part 13 according to the present exemplary embodiment has a plate shape bent from an upper end 122A of the connection part 12, as illustrated in FIG. 2A. The engagement part 13 is located on the upper side of the lower surface 801 by passing through the through hole 801A provided in the lower surface 801 and is engaged with the lower surface 801 although details will be described later with reference to FIG. 3C.

Note that a width, in the y direction, of the through hole 801A provided in the lower surface 801 of the image forming apparatus 8 is larger than widths, in the y direction, of portions of the engagement part 13 and the connection part 12 that pass through the through hole 801A.

The load receiving part 14 is provided on a side (+x direction) opposite to the engagement part 13 relative to the connection part 12 and receives a load of the image forming apparatus 8. More specifically, the load receiving part 14 makes contact with the lower surface 801 and receives the load of the image forming apparatus 8 in the attachment state, as illustrated in FIG. 2B.

As illustrated in FIGS. 2A and 2B, the load receiving part 14 according to the present exemplary embodiment is a curved surface. In other words, in the attachment state, a part that makes contact with the lower surface 801 of the image forming apparatus 8 as the load receiving part 14 has curvature.

Note that the width, in the y direction, of the through hole 801A provided in the lower surface 801 of the image forming apparatus 8 is smaller than a distance between the two load receiving parts 14*a* and 14*b*. With this configuration, the load receiving parts 14*a* and 14*b* make contact with parts of the lower surface 801 where the through hole 801A is not provided and receive the load.

The fixing member 1 according to the present embodiment is formed from a single plate member. That is, the load receiving part 14 and the connection part 12 adjacent to the load receiving part 14 are made of a common plate member.

The load receiving part 14 is a curved surface formed by hemming-bending, toward the bent part 123, a plate member extending continuously from the upper end 122A of the connection part 12.

This makes it easy to form the load receiving part 14. Furthermore, the load receiving part 14 is kept from becoming large as compared with a case where hemming bending is not used. This contributes to improvement of workability related to attachment of the fixing member 1.

The lateral supporting part 15 is a part extending laterally from the connection part 12, and supports the load of the image forming apparatus 8 when an amount of deformation of the fixing member 1 caused by the load becomes large (described later with reference to FIG. 3C). In this way, an amount of deformation of the fixing member 1 may be kept from becoming larger than a predetermined amount.

The lateral supporting part 15 according to the present exemplary embodiment is a part that is formed by bending a plate member continuous from the upper part 122 of the connection part 12 and extend toward the −x direction.

Attachment of Fixing Member 1

Next, a procedure of attaching the fixing member 1 is described.

Figure 3A:
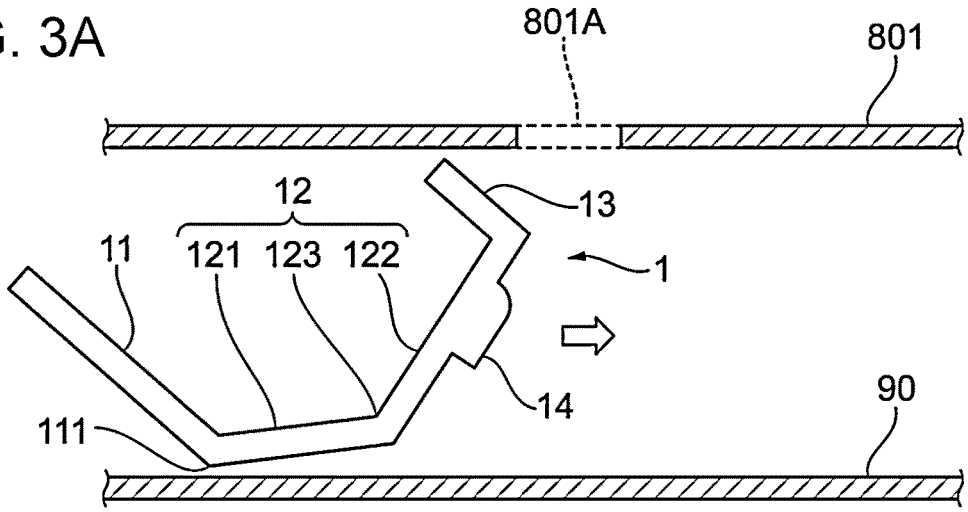
FIGS. 3A to 3C are views for explaining a procedure for attaching the fixing member.
Figure 3B:
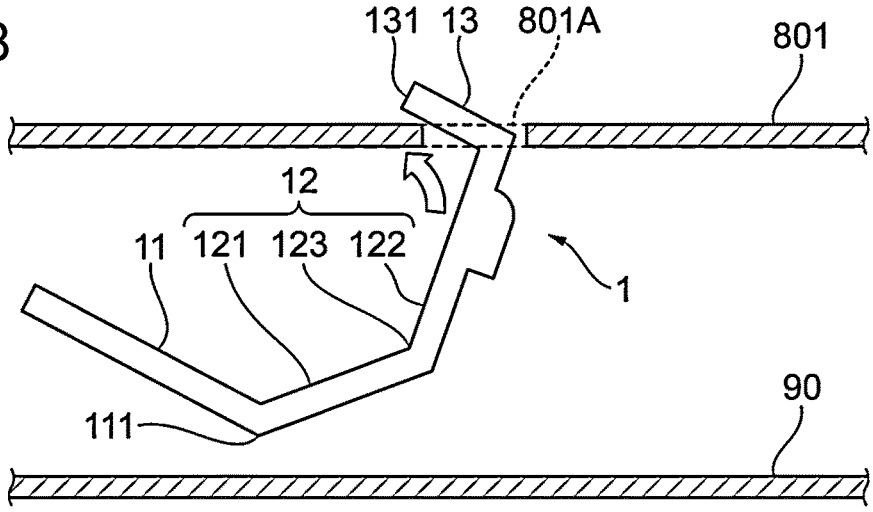
Figure 3C:
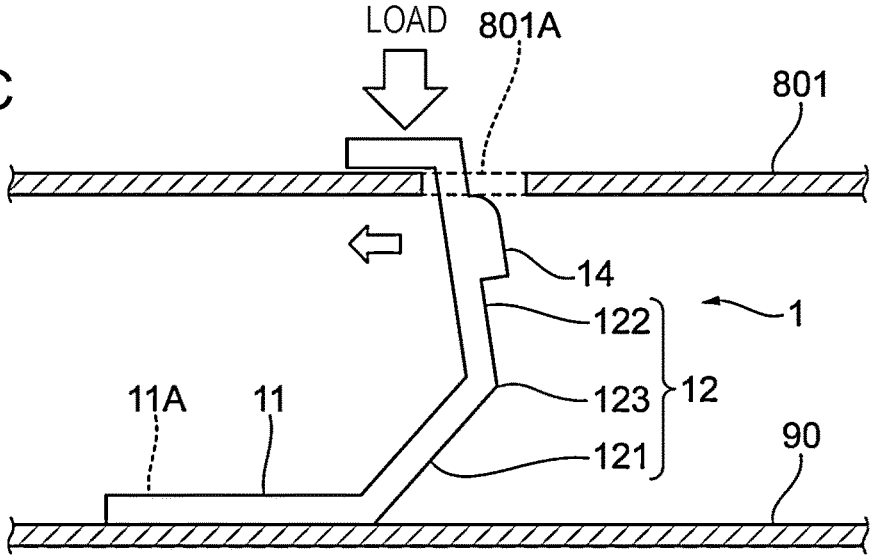

FIGS. 3A to 3C are views for explaining a procedure of attaching the fixing member 1, and FIG. 3A illustrates how the fixing member 1 is inserted between the lower surface 801 of the image forming apparatus 8 and the upper surface 90 of the pallet 9, FIG. 3B illustrates how the engagement part 13 is inserted through the through hole 801A, and FIG. 3C illustrates how the engagement part 13 is engaged. Each of FIGS. 3A to 3C is a cross-sectional view taken along line IIB-IIB, as with FIG. 2B.

First, as illustrated in FIG. 3A, the fixing member 1 is inclined about the end part 111 of the attachment part 11 (in a clockwise direction in the example of FIG. 3A). Note that the fixing member 1 needs to be thus inclined since a height (a dimension in the z direction in FIGS. 2A and 2B) of the fixing member 1 is larger than the distance between the lower surface 801 and the upper surface 90.

Then, the fixing member 1 is inserted into a space between the lower surface 801 and the upper surface 90 as indicated by the white arrow.

Next, as illustrated in FIG. 3B, a leading end 131 of the engagement part 13 of the fixing member 1 is passed through the through hole 801A of the lower surface 801.

Then, as indicated by the white arrow, an angle of the fixing member 1 is adjusted by inclining the fixing member 1 in a direction (a counterclockwise direction in FIG. 3B) opposite to FIG. 3A about the end part 111.

In this way, the engagement part 13 passes through the through hole 801A. Furthermore, the upper end of the connection part 12 passes through the through hole 801A.

The adjustment of the angle of the fixing member 1 is performed until the attachment part 11 and the upper surface 90 become substantially parallel with each other, as illustrated in FIG. 3C.

Then, a position of the fixing member 1 is adjusted until the connection part 12 hits an edge (a left end in FIG. 3C) of the through hole 801A, as indicated by the white arrow. In this way, the engagement part 13 is engaged with the lower surface 801.

After the procedure illustrated in FIGS. 3A to 3C is completed, the screw member (not illustrated) is passed through the screw hole 11A and fastened, and thereby attachment of the fixing member 1 is completed, and the attachment state is achieved.

Note that in the present exemplary embodiment, the load receiving part 14 in the procedure of FIG. 3C and in the attachment state is in contact with a lower side of the lower surface 801.

A fixing member to which the present exemplary embodiment is not applied is described with reference to FIG. 4.

Figure 4:
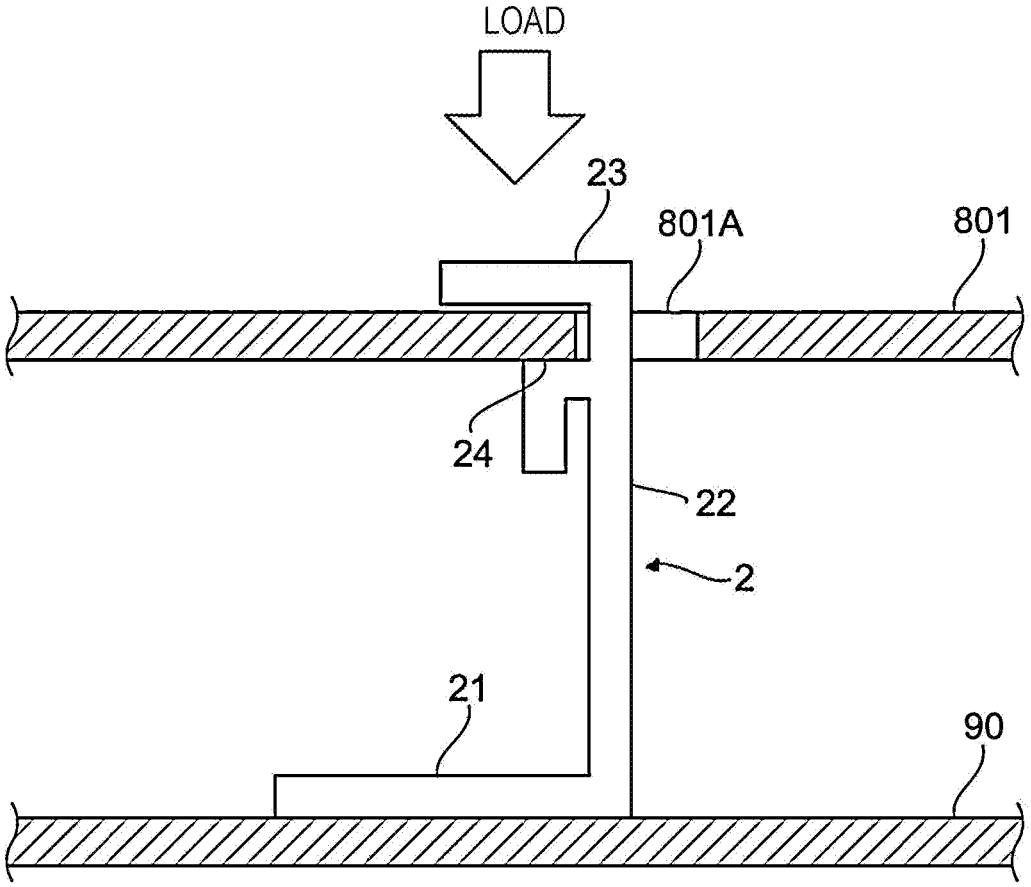
FIG. 4(Prior Art)
FIG. 4 illustrates a fixing member according to a comparative example to which the exemplary embodiment of the present disclosure is not applied.

FIG. 4 illustrates a fixing member 2 according to a comparative example to which the exemplary embodiment of the present disclosure is not applied. Note that FIG. 4 corresponds to the cross-sectional views illustrated in FIG. 2B and FIG. 3C and illustrates a state where the fixing member 2 is attached to the lower surface 801 of the image forming apparatus 8 and the upper surface 90 of the pallet 9.

The fixing member 2 includes an attachment part 21 attached to the upper surface 90 of the pallet 9, an engagement part 23 engaged with the lower surface 801 of the image forming apparatus 8, a connection part 22 that connects the attachment part 21 and the engagement part 23, and a load receiving part 24 that receives a load of the image forming apparatus 8. Note that in the fixing member 2, the connection part 22 has no bent part (is flat) for simplification.

As illustrated in FIG. 4, in the fixing member 2 according to the comparative example, the load receiving part 24 is provided on a same side (−x direction side) as the engagement part 23 relative to the connection part 22.

Therefore, in a case where the fixing member 2 is attached in a similar manner to the fixing member 1 to which the present exemplary embodiment is applied, the load receiving part 24 and the lower surface 801 interfere with each other in a procedure (similar to FIG. 3B) of passing the engagement part 23 through the through hole 801A and engaging the engagement part 23. This lowers workability related to attachment of the fixing member 2.

On the other hand, in the fixing member 1 to which the exemplary embodiment of the present disclosure is applied, the load receiving part 14 is provided on a side (the +x direction in FIG. 2B) opposite to the engagement part 13 relative to the connection part 12.

Therefore, the load receiving part 14 is less likely to interfere with the lower surface 801 in the procedure (see FIG. 3B) of passing the engagement part 13 through the through hole 801A and engaging the engagement part 13. This may keep workability related to attachment of the fixing member 1 from decreasing.

Furthermore, in the fixing member 1 to which the exemplary embodiment of the present disclosure is applied, the bent part 123 of the connection part 12 is provided so as to be bent in a direction (+x direction in FIG. 2B) away from the engagement part 13.

This may make it easier to incline the fixing member 1, for example, in the procedure of FIG. 3B, thereby making it easier to attach the fixing member 1, than in a case where the bent part 123 is provided so as to be bent in a direction (the −x direction in FIG. 2B) toward the engagement part 13.

Furthermore, in the connection part 12 according to the present exemplary embodiment, the bent part 123 is provided closer to the attachment part 11 than to the engagement part 13. This may make it easier to incline the fixing member 1, for example, in the procedure of FIG. 3A, thereby making it easier to attach the fixing member 1, than in a case where the bent part 123 is provided closer to the engagement part 13 than to the attachment part 11.

Action of Load Receiving Part 14

Action of the load receiving part 14 is described in detail below with reference to FIG. 3C.

As illustrated in FIG. 3C, in the attachment state of the fixing member 1, the load receiving part 14 is in contact with the lower side of the lower surface 801. In a case where no external force is applied in a state where the image forming apparatus 8 and the pallet 9 are standing still, the load of the image forming apparatus 8 is supported by the caster 81 (see FIG. 1), and a load applied to the load receiving part 14 is smaller than the load of the image forming apparatus 8 and is, for example, substantially zero.

In the attachment state, external force such as a shake or a shock is sometimes applied to the image forming apparatus 8 and the pallet 9, for example, in a case where the image forming apparatus 8 and the pallet 9 are transported.

When the external force is applied, the lower surface 801 of the image forming apparatus 8 and the upper surface 90 of the pallet 9 are elastically deformed, and thereby force directed from the lower surface 801 toward the upper surface 90 (force that brings the lower surface 801 and the upper surface 90 closer to each other) acts. This force is supported by the load receiving part 14.

This may reduce a load supported by the caster 81 upon application of external force and thereby prevent the caster 81 from being damaged, for example, as compared with a case where the load receiving part 14 is not provided.

Furthermore, for example, since the lower surface 801 is supported by the load receiving part 14, an amount of deformation of the lower surface 801 may be reduced, and therefore the lower surface 801 may be kept from being damaged.

Note that in the fixing member 1 to which the present exemplary embodiment is applied, the lateral supporting part 15 is provided, and a load is also supported by the lateral supporting part 15 when the deformation amount becomes large, and therefore a further increase of the deformation amount is less likely to occur. That is, the deformation amount may be kept from becoming larger than a predetermined amount.

When force acting from the lower surface 801 toward the upper surface 90 becomes too large upon application of external force, the fixing member 1 is sometimes plastically deformed.

In the fixing member 1 to which the present exemplary embodiment is applied, since the bent part 123 is provided, a direction of the plastic deformation is guided to such a direction that the bent part 123 is bent more.

This may make it less likely for the fixing member 1 to be plastically deformed irregularly, thereby making it easier to detach even the plastically deformed fixing member 1 than in a case where the bent part 123 is not provided.

Modifications or the Like

Although the connection part 12 has the bent part 123 in the present exemplary embodiment, the bent part 123 is not necessarily needed. For example, the connection part 12 may be flat without a bent part, as in the fixing member 2 according to the comparative example illustrated in FIG. 4.

Although the load receiving part 14 is a curved surface, the load receiving part 14 may be a flat surface. For example, in FIG. 2B, a flat load receiving part 14 extending in the +x direction may be provided. The curved surface may be formed by a processing method different from hemming bending.

Furthermore, instead of forming the load receiving part 14 by bending, a protrusion may be provided on a surface, on the +x direction side, of the upper part 122 of the connection part 12, and this protrusion may be used as the load receiving part 14.

Furthermore, the number of load receiving parts 14 is not limited, and may be one or may be two or more. Note that although an example in which the fixing member 1 is formed from a single plate member has been illustrated, the fixing member 1 may be a combination of plural parts.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

APPENDIX (((1))) A fixing member that fixes a lower surface of an apparatus having a caster to an upper surface of a base, the fixing member including: an engagement part that is inserted through a through hole provided in the lower surface of the apparatus, extends along an upper side of the lower surface of the apparatus, and is engaged with the lower surface of the apparatus; an attachment part that extends along an upper side of the upper surface of the base so as to face the engagement part and is attached to the upper surface of the base; a connection part that connects the engagement part and the attachment part by passing through the through hole; and a load receiving part that is provided on a side opposite to the engagement part relative to the connection part and receives a load by making contact with a lower side of the lower surface of the apparatus.

(((2))) The fixing member according to (((1))) configured such that the load receiving part and the connection part are made of a common plate member.

(((3))) The fixing member according to (((2))) configured such that the load receiving part is a curved surface formed from the plate member.

(((4))) The fixing member according to (((3))) configured such that the load receiving part is formed by hemming-bending the plate member.

(((5))) The fixing member according to any one of (((1))) to (((4))) configured such that the connection part has a bent part.

(((6))) The fixing member according to (((5))) configured such that the bent part is bent in a direction away from the engagement part.

(((7))) The fixing member according to (((6))) configured such that the bent part is provided closer to the attachment part than to the engagement part.

What is claimed is:

1. A fixing member that fixes a lower surface of an apparatus having a caster to an upper surface of a base, the fixing member comprising:

an engagement part that is inserted through a through hole provided in the lower surface of the apparatus, extends along an upper side of the lower surface of the apparatus, and is engaged with the lower surface of the apparatus;

an attachment part that extends along an upper side of the upper surface of the base so as to face the engagement part and is attached to the upper surface of the base;

a connection part that connects the engagement part and the attachment part by passing through the through hole; and a load receiving part that is provided on a side opposite to the engagement part relative to the connection part and receives a load by making contact with a lower side of the lower surface of the apparatus, wherein the connection part has a bent part, a lower part that extends obliquely from the bent part, and an upper part that extends obliquely from the bent part.

2. The fixing member according to claim 1, wherein the bent part is bent in a direction away from the engagement part.

3. The fixing member according to claim 2, wherein the bent part is provided closer to the attachment part than to the engagement part.

4. The fixing member according to claim 1, wherein an upper end of the upper part connects to the engagement part and a lower end of the lower part connects to the attachment part.

5. The fixing member according to claim 4, wherein the upper end and the lower end are positioned on a same side relative to the connection part in a direction perpendicular to a load receiving direction and perpendicular to a boundary line between the upper part and the lower part.

6. The fixing member according to claim 1, wherein the load receiving part and the connection part are made of a common plate member.

7. The fixing member according to claim 6, wherein the load receiving part is a curved surface formed from the plate member.

8. The fixing member according to claim 7, wherein the load receiving part is formed by hemming-bending the plate member.

* * * * *